US007591372B2

(12) United States Patent
Gelardi et al.

(10) Patent No.: US 7,591,372 B2
(45) Date of Patent: Sep. 22, 2009

(54) UNIT DOSE LOCKING CONTAINER

(75) Inventors: John A. Gelardi, Kennebunkport, ME (US); Ken Bertram, Hillsborough, NC (US); Ricky N. Williams, Pittsfield, MA (US); David L. Bolognia, Lamesboro, MA (US)

(73) Assignee: MeadWestvaco Corporation, Glen Allen, VA (US)

( * ) Notice: Subject to any disclaimer, the term of this patent is extended or adjusted under 35 U.S.C. 154(b) by 0 days.

(21) Appl. No.: 10/595,196

(22) PCT Filed: Sep. 23, 2004

(86) PCT No.: PCT/US2004/031491

§ 371 (c)(1),
(2), (4) Date: Jan. 26, 2007

(87) PCT Pub. No.: WO2005/030606

PCT Pub. Date: Apr. 7, 2005

(65) Prior Publication Data

US 2007/0102318 A1 May 10, 2007

Related U.S. Application Data

(60) Provisional application No. 60/504,977, filed on Sep. 23, 2003.

(51) Int. Cl.
*B65D 83/04* (2006.01)

(52) U.S. Cl. ..... 206/538; 206/531

(58) Field of Classification Search ..... 206/531, 206/532, 528, 538, 828, 39, 39.4, 39.5, 39.6, 206/468, 1.5, 530, 533, 539
See application file for complete search history.

(56) References Cited

U.S. PATENT DOCUMENTS 3,387,699 A 6/1968 Heller (Continued)

FOREIGN PATENT DOCUMENTS

DE 40 01 645 A1 8/1991

(Continued)

OTHER PUBLICATIONS

U.S. Appl. No. 11/969,146, filed Oct. 23, 2008, Gelardi, John A.

(Continued)

*Primary Examiner*—Bryon P Gehman
*Assistant Examiner*—Ernesto A Grano
(74) *Attorney, Agent, or Firm*—Alison R. Scheidler; Tsugihiko Suzuki

(57) ABSTRACT

A package has a sliding blister card and a locking sleeve made from a base and a top. The card is made from conventional blister dose packaging material, with blisters formed in a single layer plastic top holding medicaments on a sealing paper, board, or foil layer. The top and base form a closed case, open along one end. The blister card is slid into the sleeve until detent(s) engage aperture(s). Appurtenant(s) adjacent to the detent(s) urge the blister card to engage the detent(s) at the card's receiving aperture. Pressing on release disengages the card and detent by warping the card to move the aperture away from the detent so that the card may be slid through the open end of the sleeve. Reverse pressure easily slides the blister card back into the containment element without manipulation of parts.

10 Claims, 12 Drawing Sheets

U.S. PATENT DOCUMENTS

| | | | | |
|---|---|---|---|---|
| 4,120,400 | A | 10/1978 | Kotyuk | |
| 4,192,422 | A | 3/1980 | Kotyuk | |
| 5,019,125 | A | 5/1991 | Rebne et al. | |
| 5,275,291 | A * | 1/1994 | Sledge | 206/531 |
| 6,047,829 | A * | 4/2000 | Johnstone et al. | 206/531 |
| 6,338,408 | B1 | 1/2002 | Anderson | |
| 6,349,831 | B1 * | 2/2002 | Buss | 206/531 |
| 6,460,693 | B1 * | 10/2002 | Harrold | 206/1.5 |
| 6,491,211 | B1 * | 12/2002 | Evans et al. | 229/102 |
| 6,523,691 | B2 * | 2/2003 | Raj et al. | 206/538 |
| 6,640,693 | B2 | 11/2003 | Brezovnik et al. | |
| 6,789,677 | B2 * | 9/2004 | Maietta | 206/536 |
| 6,863,175 | B2 * | 3/2005 | Gelardi, John A. | 206/1.5 |
| 2003/0062287 | A1 | 4/2003 | Gelardi | |
| 2003/0102321 | A1 | 6/2003 | Maietta | |
| 2003/0209460 | A1 | 11/2003 | Bolnick et al. | |
| 2005/0183981 | A1 | 8/2005 | Gelardi | |

FOREIGN PATENT DOCUMENTS

| | | | |
|---|---|---|---|
| EP | 0547730 | A2 | 6/1993 |
| EP | 1 002 744 | A1 | 5/2000 |
| EP | 1277670 | B1 | 5/2005 |
| GB | 1279941 | A | 6/1972 |
| JP | 2000 062843 | | 2/2000 |
| WO | WO 2004/037657 | A2 | 5/2004 |
| WO | WO 2005/030606 | A1 | 4/2005 |
| WO | WO 2005/068304 | A2 | 7/2005 |
| WO | WO 2007/101098 | A1 | 9/2007 |

OTHER PUBLICATIONS

U.S. Appl. No. 11/969,616, filed Jan. 4, 2008, Williams, Ricky.
U.S. Appl. No. 11/969,100, filed Oct. 16, 2008, Gelardi, John A.
U.S. Appl. No. 11/994,811, filed Jan. 4, 2008, Le, Thanhhung.

* cited by examiner

UNIT DOSE LOCKING CONTAINER

CROSS-REFERENCE TO RELATED APPLICATIONS

This application claims priority to co-pending U.S. Provisional Application No. 60/504,977, filed on Sep. 23, 2003, which is entirely incorporated herein by reference.

FIELD OF THE INVENTION

The present invention relates generally to child-resistant locking containers. More specifically the present invention relates to a child-resistant case for receiving, holding, and securing a blister card with medicaments, which is configured to releasably engage the blister card by way of appurtenants positioned within the case.

BACKGROUND OF THE INVENTION

Locking containers, especially child-resistant or locking containers wherein multiple movements must be applied to open the container, have many uses. One use for locking containers is to control the dispensing of medicine or medicaments in the form of pills and tablets. Locking caps on medicine bottles are well known. The typical locking cap mechanism requires a coordinated alignment and tipping, or axial pressure, or inward radial squeezing while turning the cap to remove it from the containers and access to medicaments.

Many medicines are packaged in convenient flat boxes, which are difficult to secure with childproof locks. Many medicaments in the form of pills or tablets are available in blister cards—protective alveoli formed on a plastic sheet sealed by a paper or foil barrier that is punctured when extracting a tablet from the alveolar. When a cardboard flat box is opened the entire contents of the package is exposed, making all of the tablets immediately available. The dangers posed by children with access to a quantity of tablets not intended for their consumption is self evident.

A need exist for child-resistant flat boxes for holding medicaments. A need exists for flat boxes with locks that require coordinated motions for opening. A needs exists for medicament holding packages that present a limited number of doses at a time. A need exists for inexpensive and re-useable locking cases.

SUMMARY OF THE INVENTION

The illustrated embodiments of the present invention are directed to a child-resistant safety container for medications stored in a blister card. Generally speaking, a two-piece molded plastic container closed on three sides forms a void that receives a blister card that slidably translates through the open forth side. Appurtenants extend into the void as a means for engaging the blister card to an adjacent catch. Means for engaging include ribs and springs, attached to or formed with the molded plastic pieces as is well known to those skilled in the art, to exert a force on the card. The illustrated embodiments show two flexible springs molded on one side of the container that push the blister card against the opposite side where a catch is located and positioned to engage at least one aperture that is part of the blister card. A retainer prevents the blister card from being fully removed; however, manipulating the retainer with a thin device such as replacement blister card releases the first used blister card, which can then be slid out of the container. Posts molded on one piece are mated to and welded to the corresponding hollow cylinders molded on the other piece. Energy directors may weld side edges. This invention allows blister cards to be loaded into the case during manufacture, at the point of purchase or by a health care professional, or by the user at later times. It also reduces the cost of assembly, and provides a child-resistant, re-useable medicine dispensing case. Additional embodiments fulfill the needs for single dose dispensing packaging.

In a single dose dispensing package, a child-resistant case for dispensing medications held on a blister card has a two-piece molded plastic sleeve closed on three edges. A blister card is slidable through the open fourth edge to expose a row of blister upon a manipulation of the parts. An appurtenant, should here in the form of a dagger spring near the open edge, fits through an opening in the blister card and acts as a travel limit when the card is slid out. Additional appurtenants, such as flexible springs and rigid ribs, may be molded with or attached to a first piece and configured to force the blister card against the inside surface of whichever piece includes a molded catch or detent. The detent, shown here for purposes of teaching and not limitation on the side opposite the springs near the closed end, engages an opening in the blister card to prevent a fully inserted blister card from sliding outward. Pressing on an adjacent release distorts the blister card so that the molded catch no longer engages the opening in the blister card, which can then be removably slid outward from the container to expose the blisters. A ramp on the back of the catch depresses the blister pack as it is slid inward. Posts molded on one piece are inserted into and welded to the hollow cylinders molded on the other piece. Energy directors may sonically weld side edges, as well as the posts and cylinders.

A storing and dispensing system has a sliding blister card and a locking sleeve comprising a base and matingly connected top. The top is mated to the base by integral pins on one piece being inserted into integral cylinders on another piece and then welding the plastic sleeve shut. The card is made from conventional blister dose pack material—a single layer plastic top with formed alveoli holding pills or tablets on a sealed paper or foil base. The paper or foil is pushed in, cut, or punched beneath each blister to release the respective dose. A blister card manufactured in the convention manner, configured with at least one receiving aperture and the blisters arranged to cooperate with the internal appurtenants, provides the minimum structural rigidity for functioning of the parts.

In practice, the blister card is placed in the sleeve opening and pushed inward past the limit spring and perhaps on sliding guides between guiding cylinders and ribs. Internal appurtenant such as springs or ribs urge the blister card toward a detent. The detent or catch engages the blister card's receiving aperture to lock the card in the sleeve. To unlock the card there is provided a release. In the illustrated embodiments, manipulating the release requires pressing inward to warp a part of the card away from the catch. The warping of the card moves the receiving aperture away from the detent so that the card may be slid outward through the open end of the sleeve. Extending the card to expose the blisters is then a matter of sliding the card outwardly in increments, or fully until a receiving aperture engages a retainer. Reverse pressure easily slides the blister card back into the case.

Embodiments according to this invention offer at least the following advantages: lightness in weight, resistance to tampering, child-resistance, ease of access, excellent durability, ease of assembly, repeated use, and excellent economy. It is also contemplated that the present invention is not limited to pharmaceutical-related goods, but is applicable to a plethora of delicate, sensitive, or unique portable goods. Other advantages of the present invention will be apparent from the following description, the accompanying drawings, and the appended claims.

DETAILED DESCRIPTION

As required, detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details disclosed herein are not to be interpreted as limited, but as a basis for the claims and for teaching one skilled in the art to variously employ the present invention.

Figure 1:
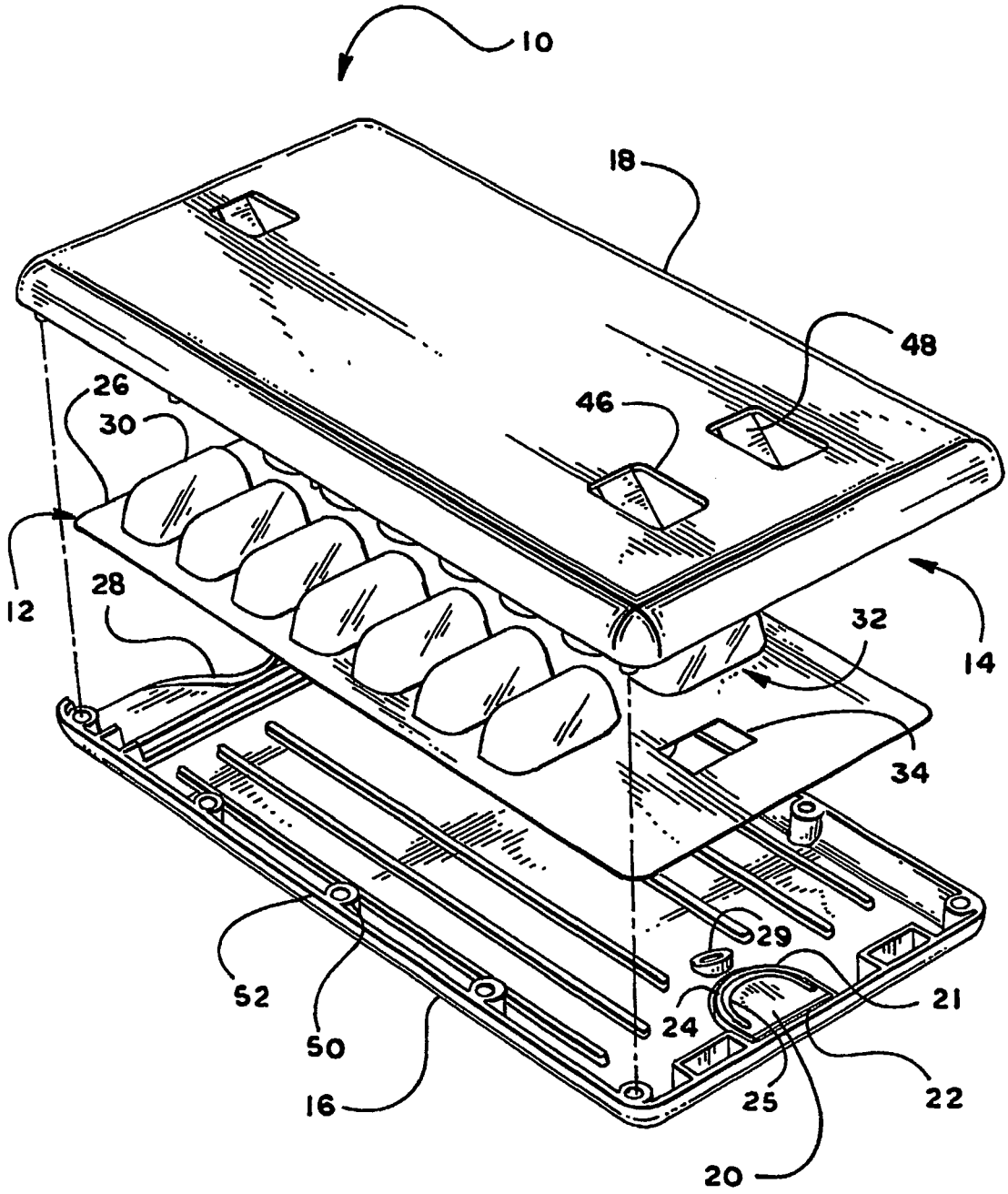
FIG. 1 is an exploded top perspective view of the locking blister package.
Figure 2:
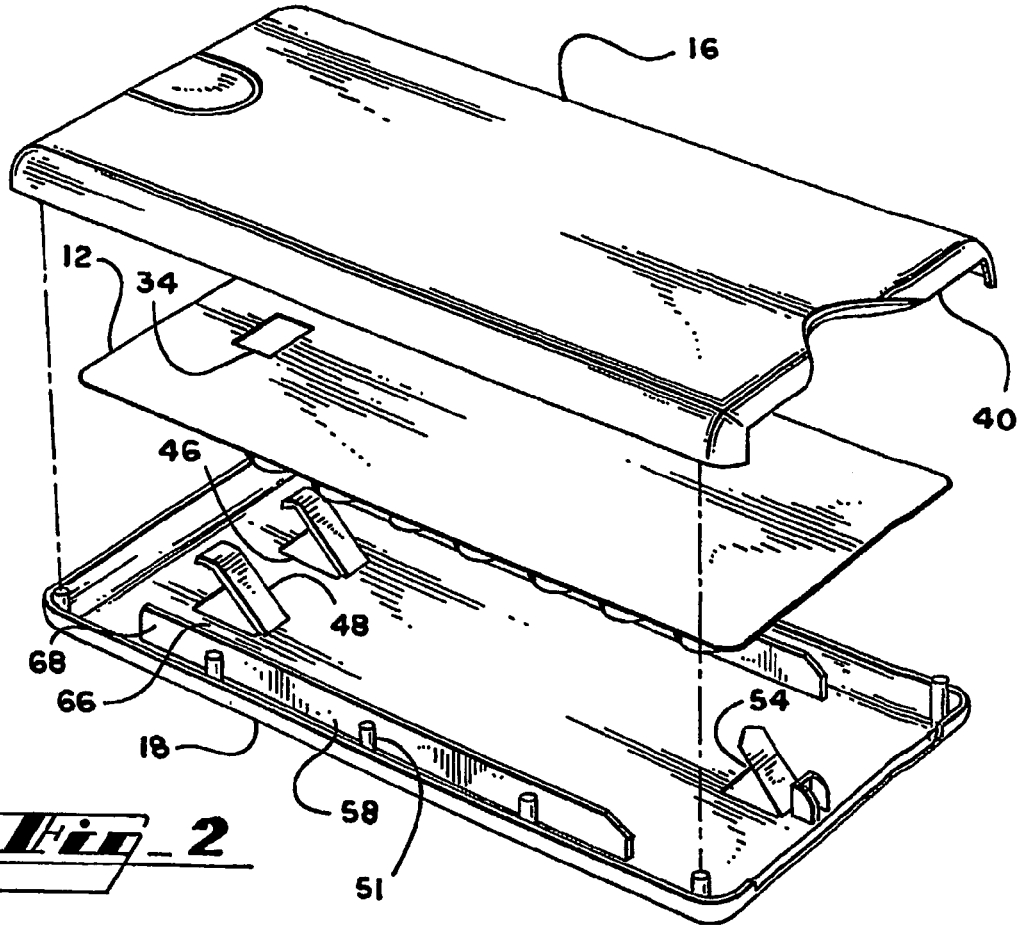
FIG. 2 is an exploded bottom perspective view of the locking package.
Figure 3:
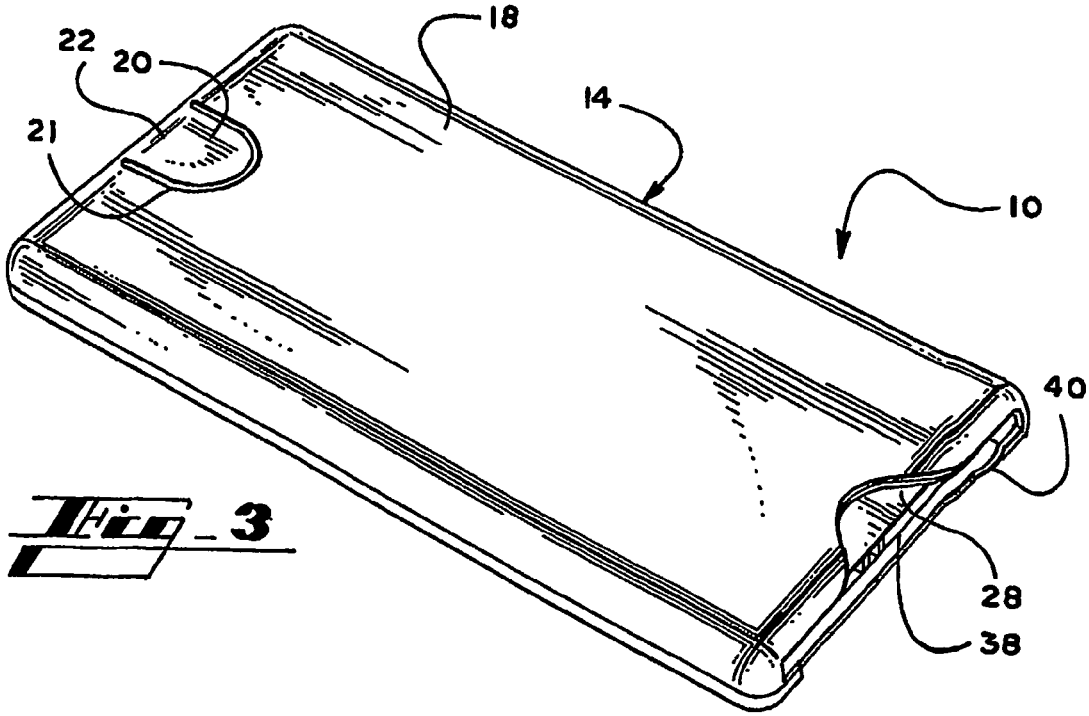
FIG. 3 is a bottom perspective view of the closed locking package.

Referring now to the drawings, wherein like numerals represent like features throughout, there are illustrated embodiments of the present invention. Turning first to FIGS. 1-3, there are shown top and bottom exploded views and a bottom view of the locking package. As shown in FIG. 1, a locking case 10 has a sliding unit dose blister card 12. The locking sleeve 14 has a base 16 and a top 18. A push U-shaped flap 20 is formed in an opening 21 and is connected to and integrally formed with the case by a thin resilient living hinge section 22. Pushing on the free end 24 of the push release flap frees the tray 12. The inside of free end 24 has a curved rim 25. Gripping the card's exposed end 26 in the recess 28 of the open end and pulling outward while flap 20 is depressed permits the outward sliding and removal of the card from the case to expose the blisters.

The blister card 12 has single dose-containing blisters 30 arranged in two columns 32. This particular arrangement permits the blisters to avoid certain internal features of the illustrated embodiments when the card is being slid inwardly or outwardly. The card is constructed in the manner well known by those skilled in the art, and includes one or more aperture for engaging internal features. The illustrated blister card 12 has one aperture or hole 34, configured to act as both a detent receiver and a retainer receiver, which cooperatively engages the card and prevents removal of the card from the sleeve 14. In the illustrated embodiments, aperture 34 is positioned beyond the blisters 30 and cooperates with the detent 29 to prevent movement or translation of the card until it is intentionally released by pressing or otherwise properly manipulating the release 20.

In alternative embodiments a rib 38 at the end of the card closes the open end 40 of the sleeve 14 when the card is fully recessed within the case, further preventing access to the blisters 30. The rib fits within cutout 28 and aids in outward sliding of the card. As best shown in FIG. 3, in the closed position rib 38 further seals open end 40 of the sleeve 14 by pressing against the inside of the top 18.

Openings 46 in the sleeve top 18 allow the inward forming of a means for engaging, here illustrated as springs 48, which press the card and urge hole 34 into engagement with retaining detent 29. Additional means for engaging include ribs, leaf springs, dagger springs, and similar configurations, as well known to those skilled in the art, which exert a force on the card. As will be understood, the means for engaging does not have to be opposite the detent, rather the means for engaging and the detent are merely configured to cooperatively engage the detent retainer 34 of the card.

Cylinders 50 along side walls 52 of the base 16 are ready to receive pins 51 extending downward from the top. A retainer 54, illustrated as the spring centered in the top 18 near the open end 40 above the recess 28, extends through the retainer receiver, illustrated as aperture 34, to prevent complete unintentional removal of the card. Detent 29 projects through the detent retainer, here illustrated as hole 34, to lock the tray 12 in the sleeve 14. Retainer 54 may be depressed by an inserted blade or replacement card to withdraw the spring from hole 34 for releasing an empty blister card 12 in preparation for inserting of a full blister card. Inner ribs 58 stabilize the card as it is slidably translated in and out of the base.

Figure 4:
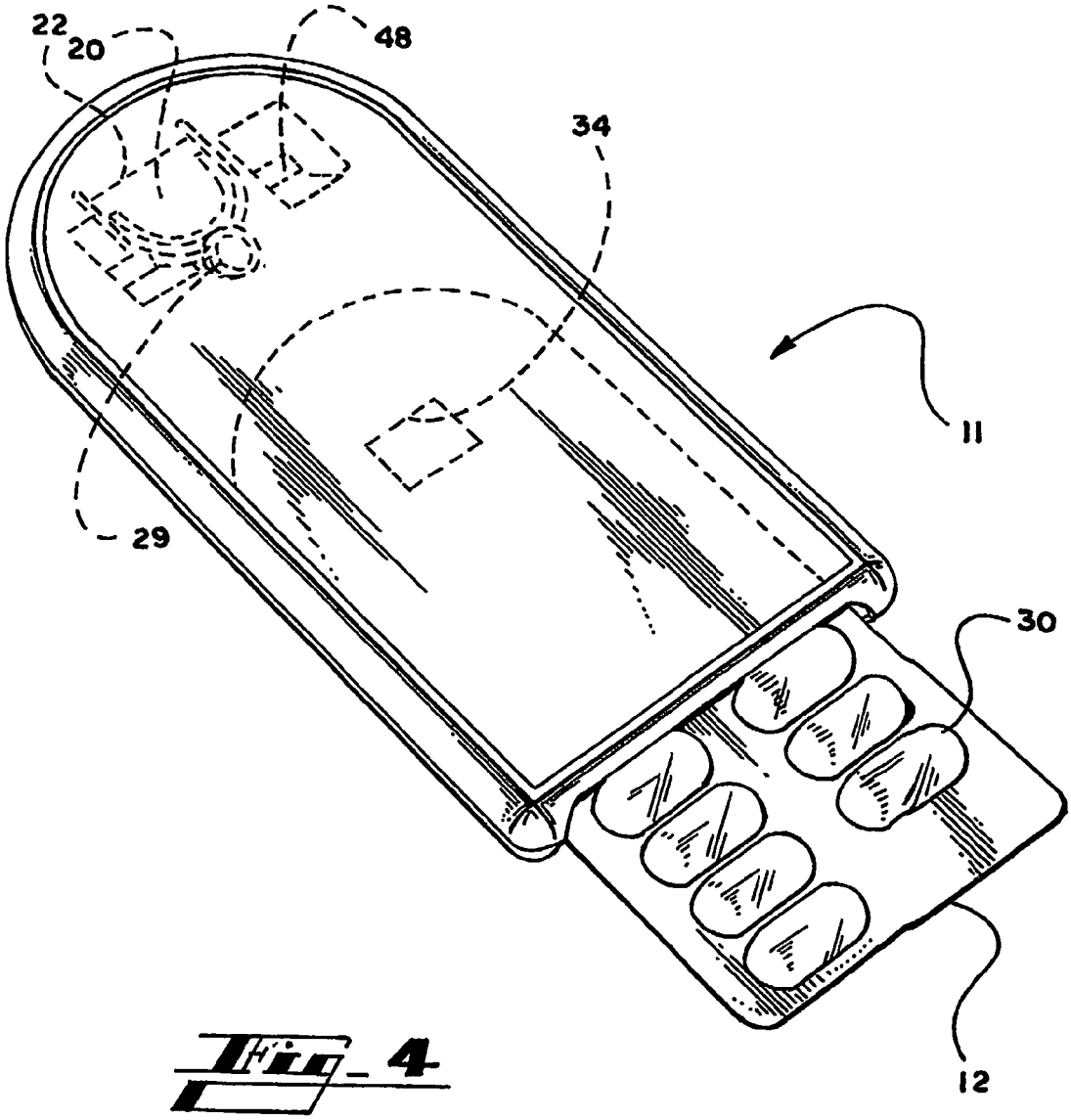
FIG. 4 is a transparent top perspective view of the locking package with the blister panel moved partially outward from a slightly modified rounded closed end container.

FIG. 4 shows a partially extended transparent sleeve top view of a closed modified rounded end locking case 11. In the illustrated configuration, after the top 18 is assembled on the base 16, the card is placed in the case. Alternatively, the card may be placed on the base before assembly.

Figure 5:
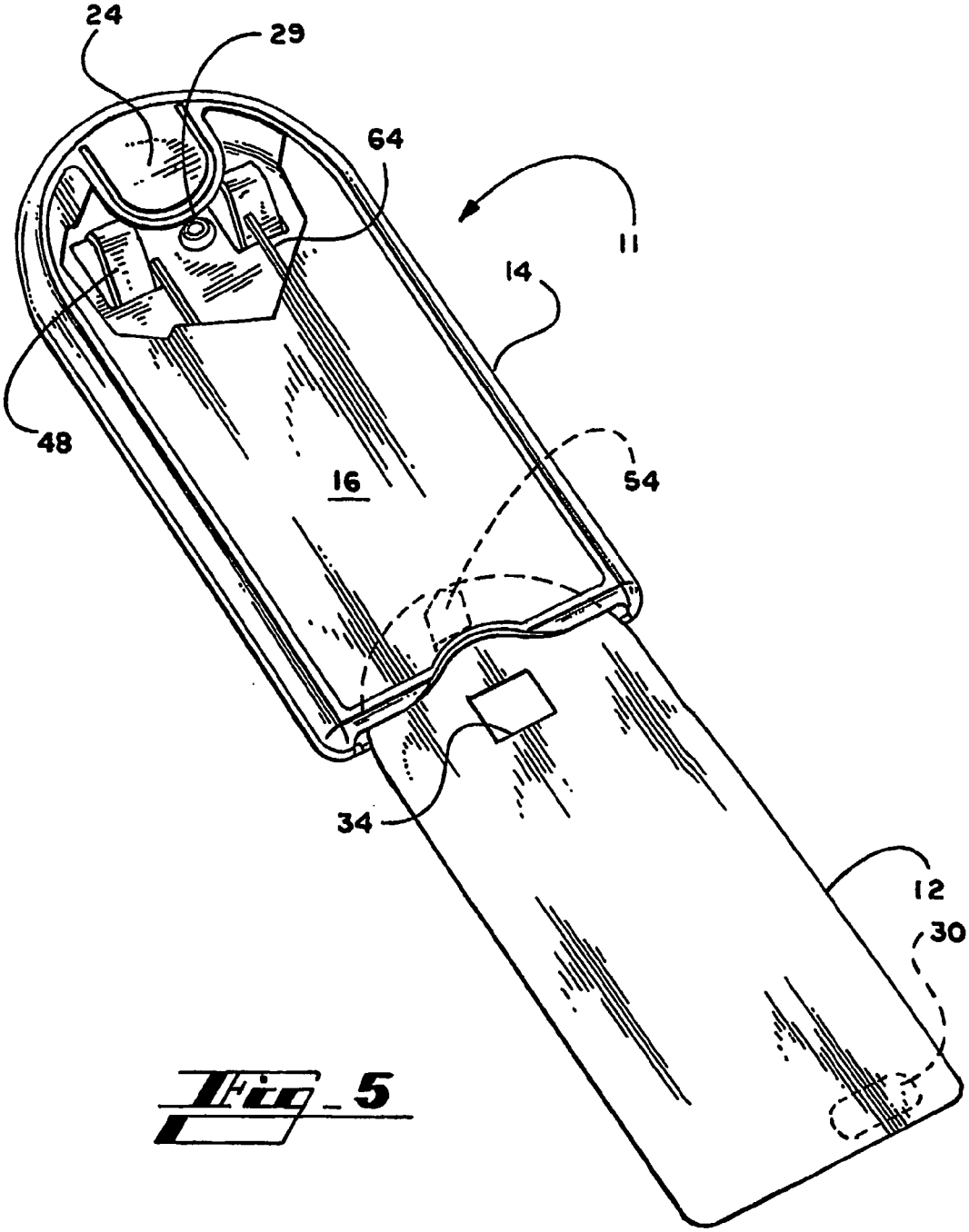
FIG. 5 is a top perspective transparent view of the container with the blister panel ready for loading.
Figure 6:
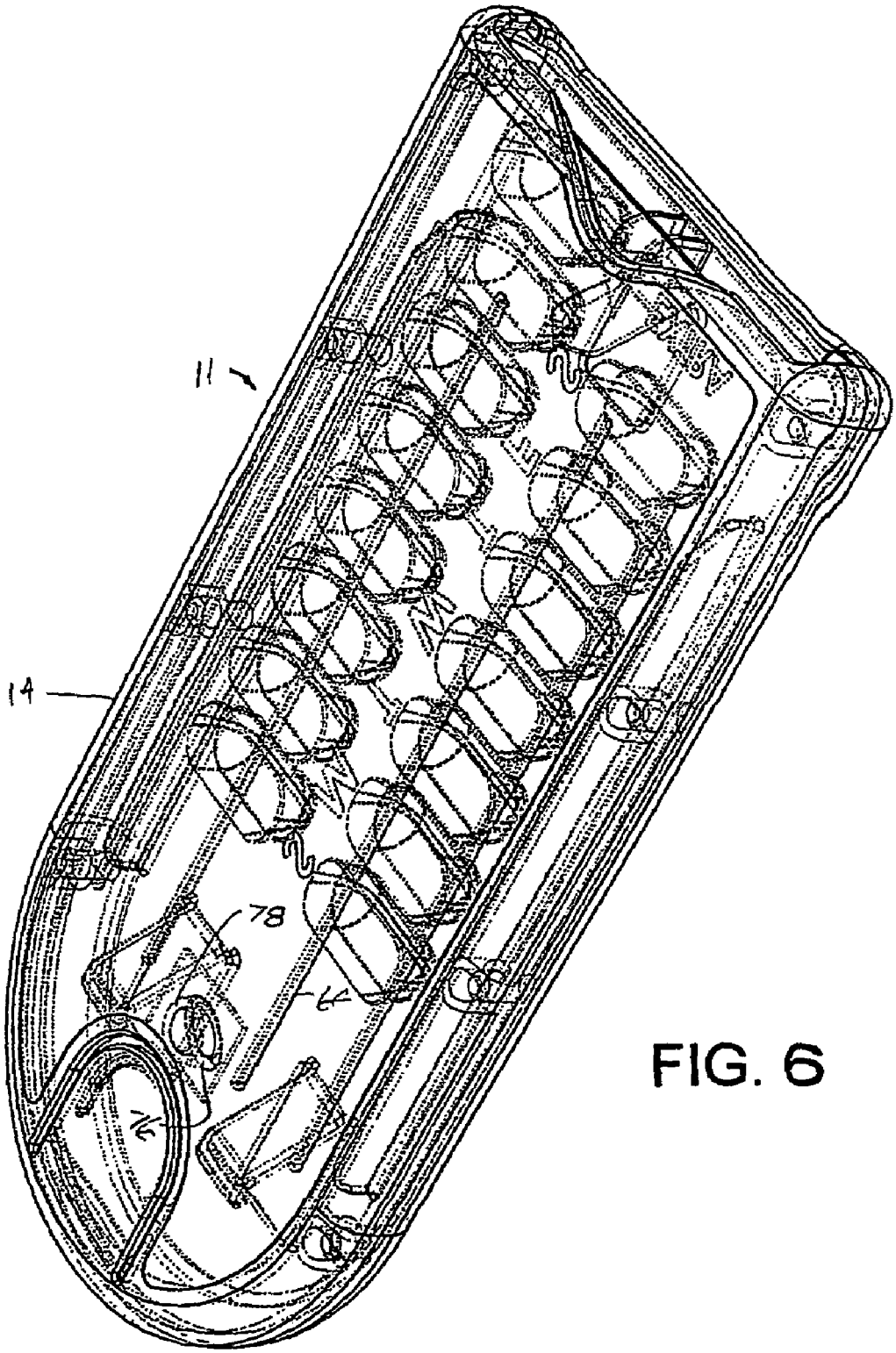
FIG. 6 is a transparent perceptive bottom view of the container.
Figure 7:
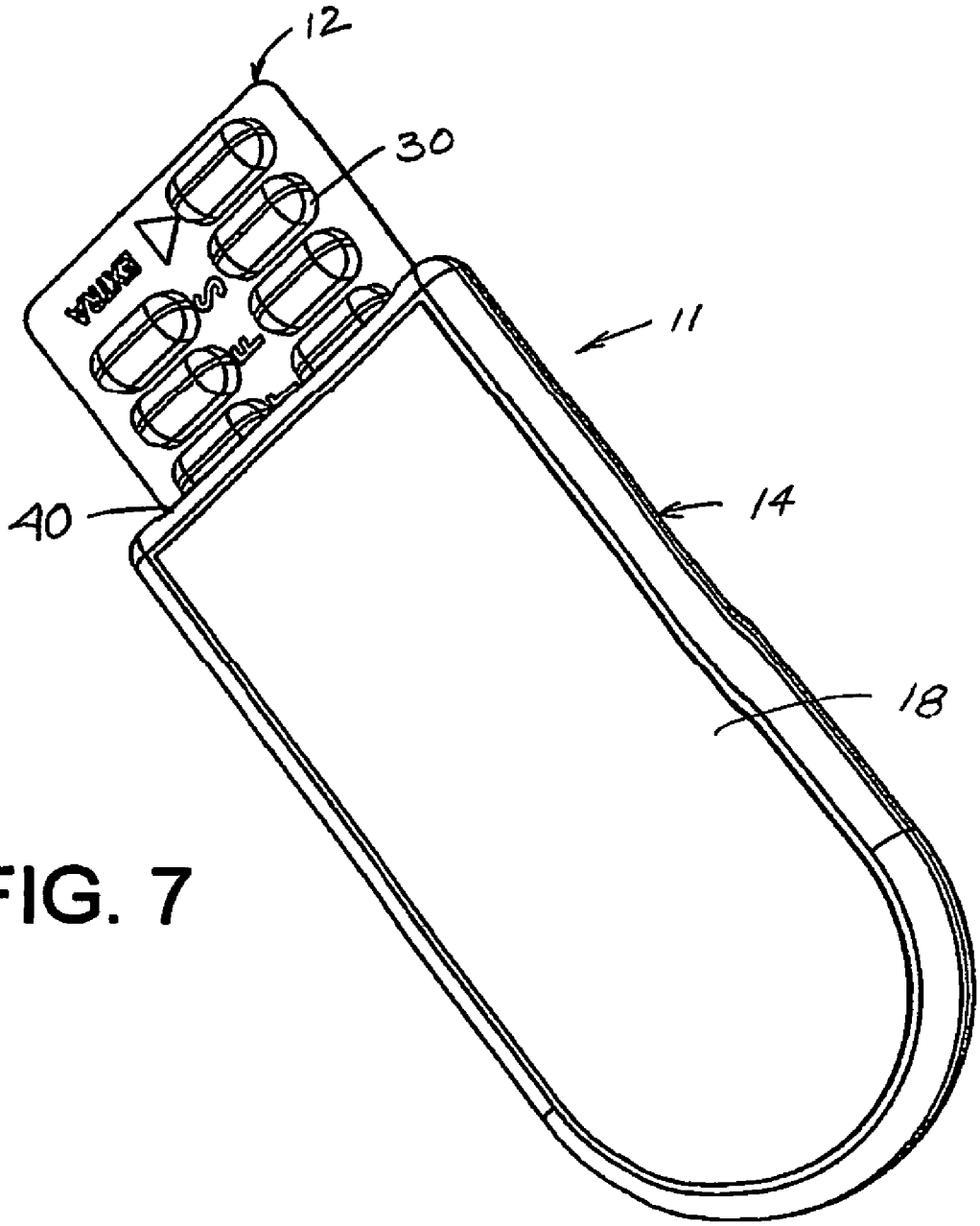
FIG. 7 is a perspective top view of the locking package with the blister panel slid partially outward.
Figure 8:
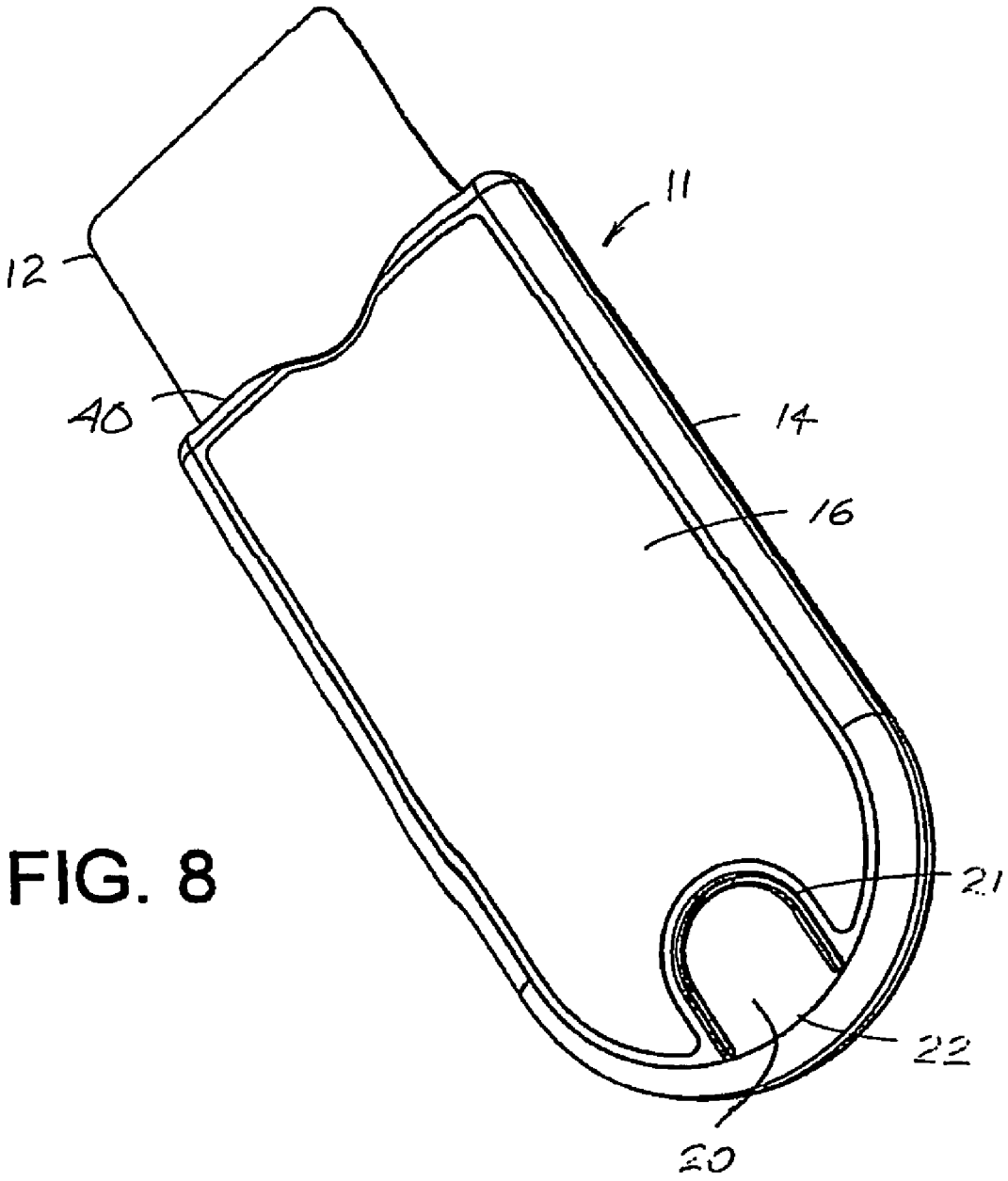
FIG. 8 is a perspective bottom view of the locking package.
Figure 9:
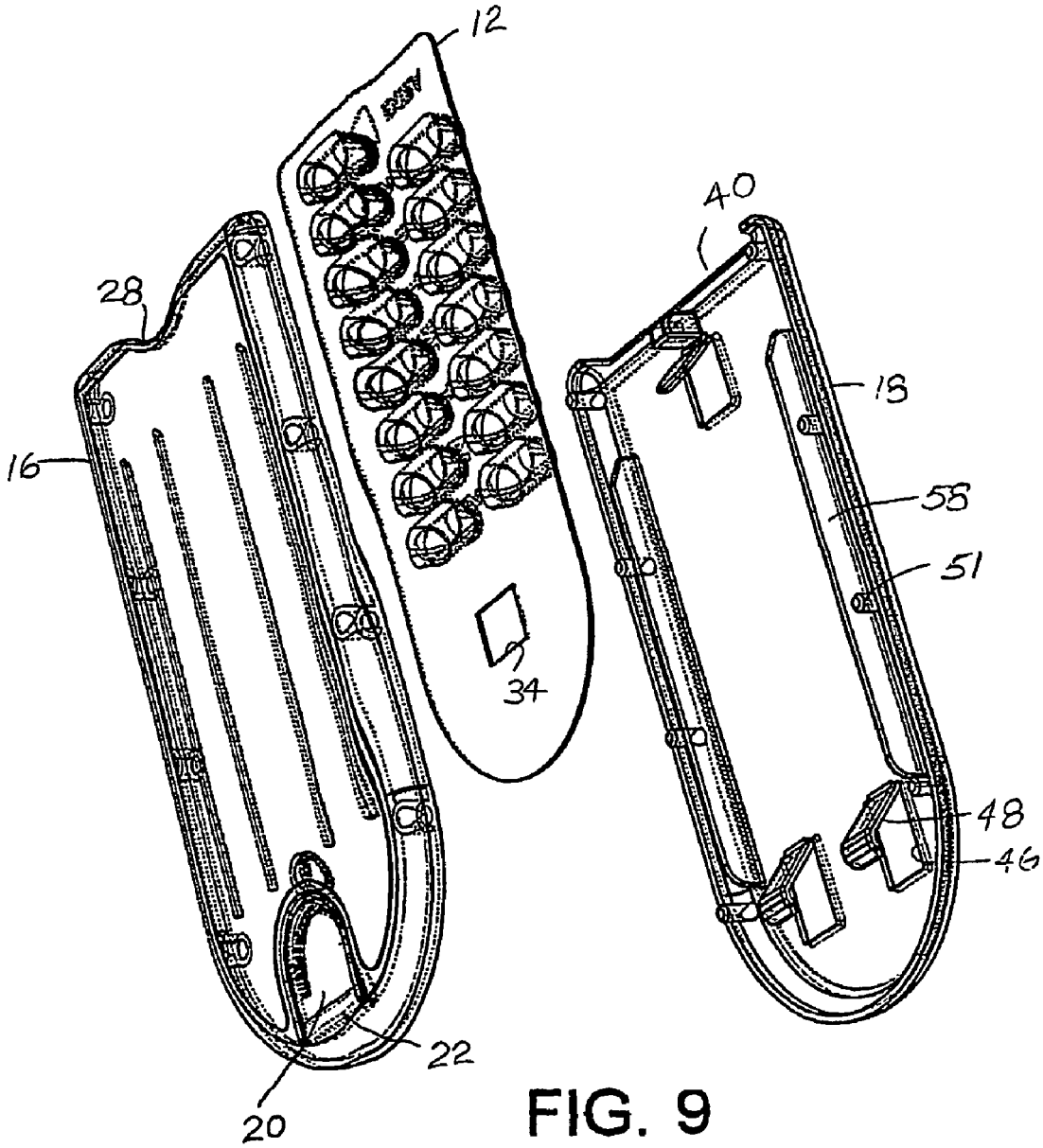
FIG. 9 is an exploded bottom perspective view of the open container and bubble tray.
Figure 10:
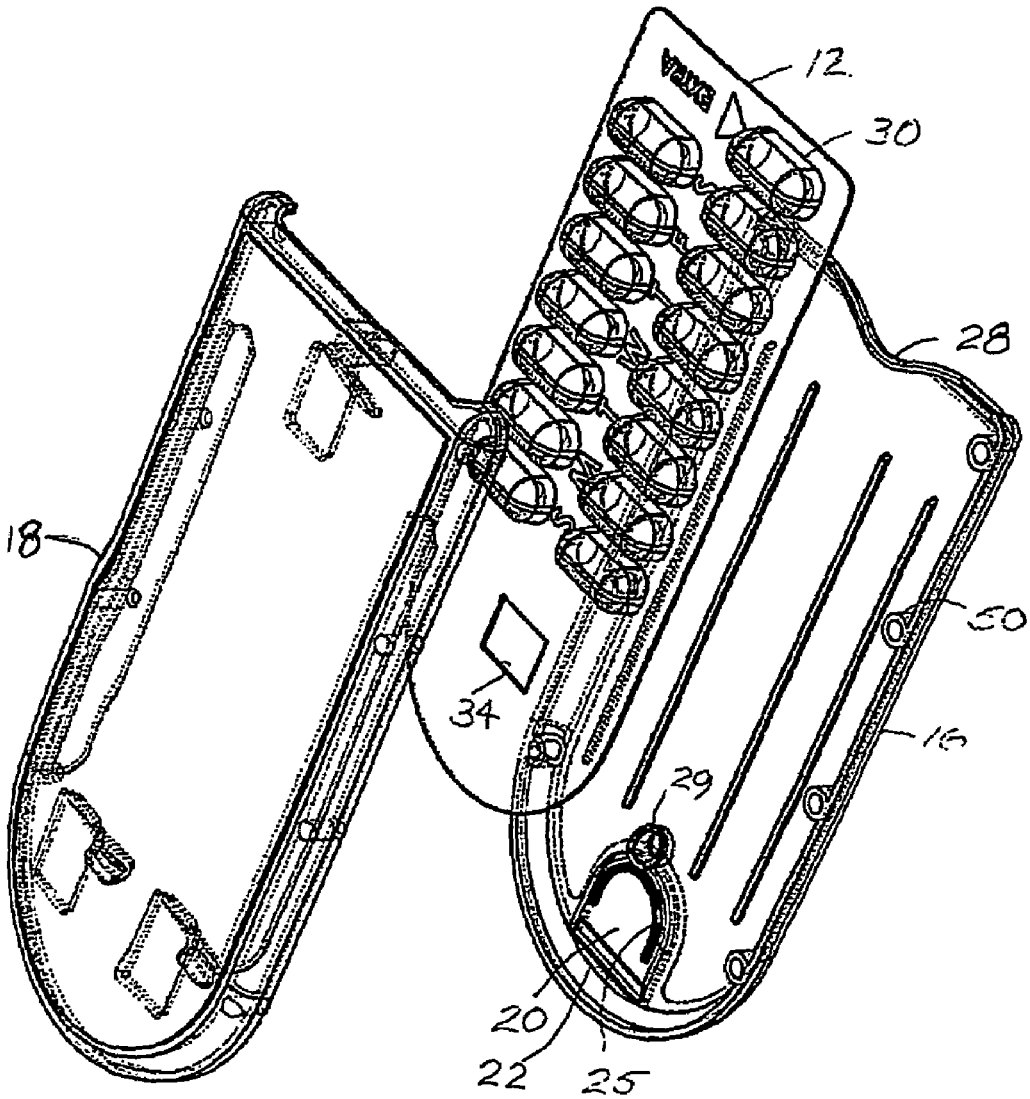
FIG. 10 is an exploded perspective top view of the container and bubble tray.
Figure 11:
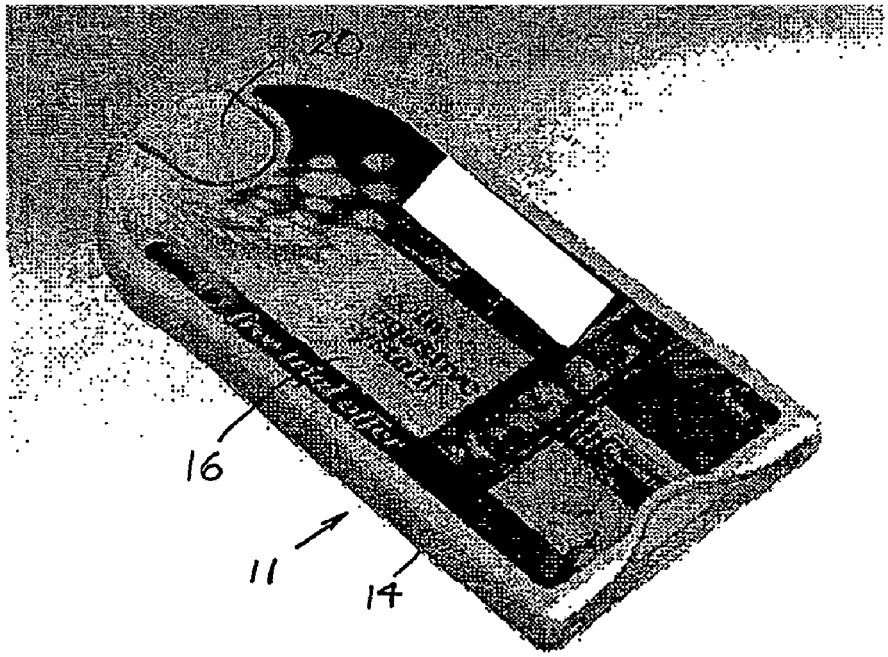
FIG. 11 is a bottom perspective assembled view of the closed package.
Figure 12:
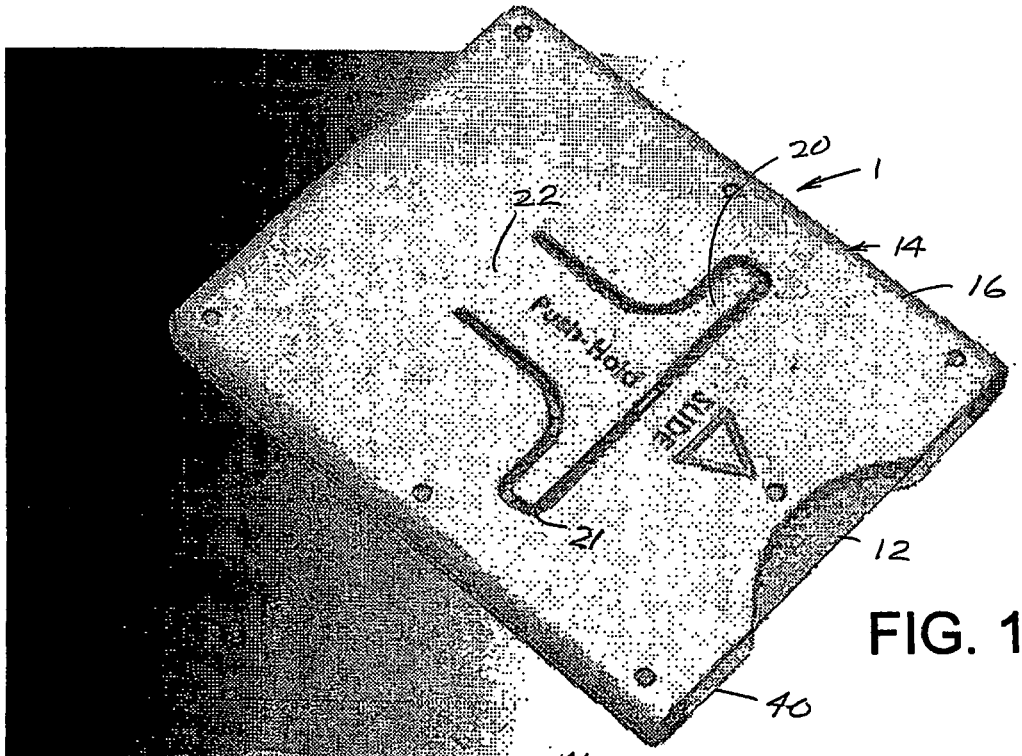
FIG. 12 is an alternative package with multiple detent openings in the blister panel and a T-shaped release panel.
Figure 13:
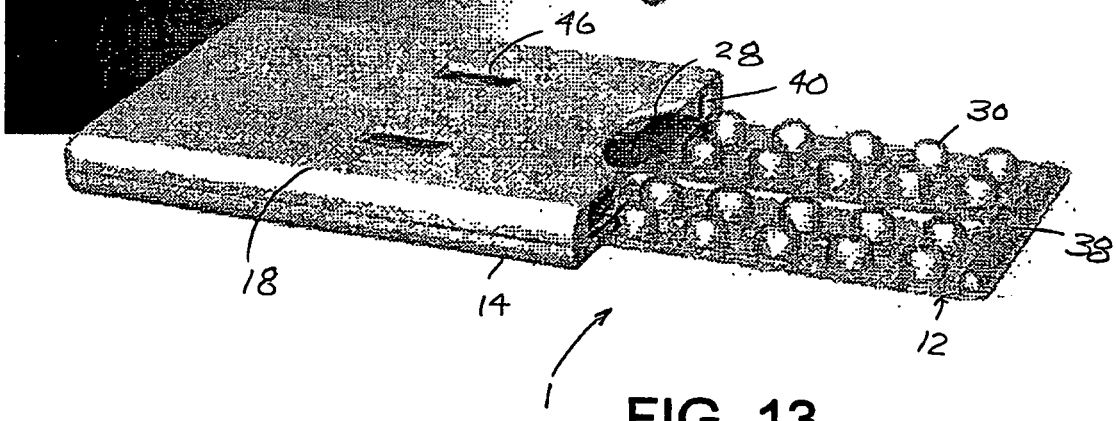
FIG. 13 is a top perspective view of the package of FIG. 12 showing positions of elements of the base, top and bubble tray.
Figure 14:
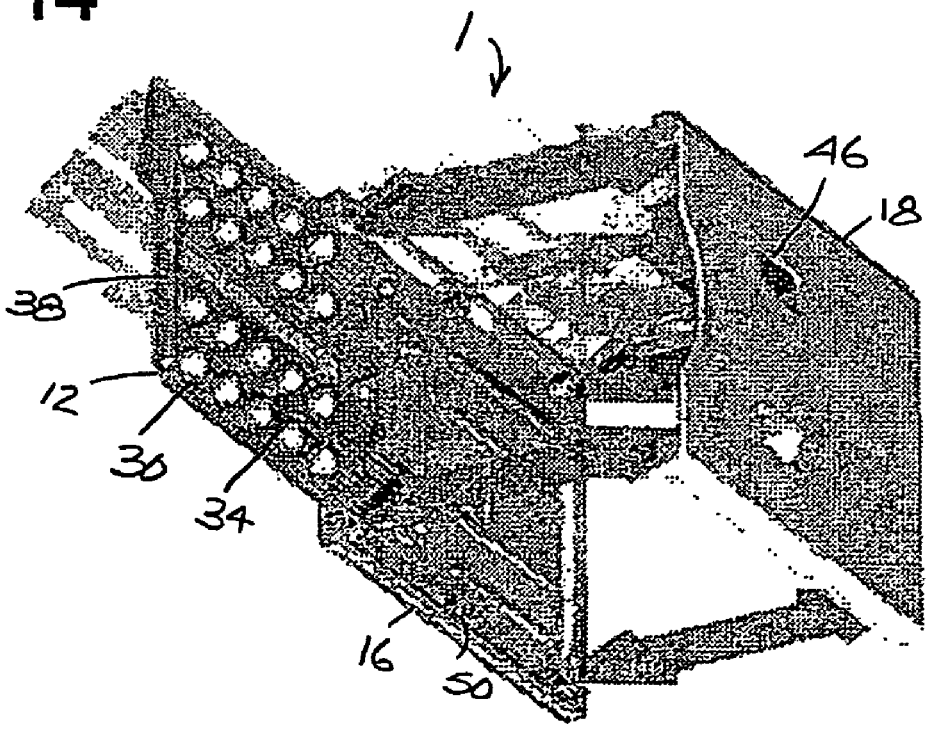
FIG. 14 is an exploded perspective view showing positions of elements of the base, top and bubble tray.

FIG. 5 is a transparent bottom view of the sleeve 14 of package 11 ready for insertion of the card 12. The inside of the top 18 has ribs aligned between springs 48 to hold the card against guides 64 on the inside of the base 16. The ribs and springs 48 are of sufficient height so that the blisters are spaced from the inside of the top.

The head 24 of the U-shaped flap 20 is aligned between the ribs or springs 48 to warp the card in the direction of the springs at gaps 66 (best shown in FIG. 2) between inner ends 68 of the ribs 58, to release the hole 34 from the detent 29. Optional guides 64 on the inside of the base facilitate sliding of the card. Ridges 58 at the inside of base side walls 52 may fit inside of complementary side walls on the top 18. Push tray release flap 20 includes a rib 25 on the inside of the head 24 of the flap that cooperates with the detent 29. As the rib 25 is pushed inward, an adjacent part of the blister card is warped toward the top 18 against the engaging appurtenants 48, releasing the card from engagement with detent 29.

Detent 29 has a straight or hook-shaped inward face to hold the card and prevent outward movement unless push bar 20 and rib 25 warp the card away from the detents. Sloping outer face on the detent warps the card away from the detent upon inward movement of the card, allowing free inward movement upon pushing on the free end of the card.

Initials of days of the week or other compliance related indicia located between the bubbles serve as reminders. After a pill is removed from a blister 30, the card may be returned into the case by sliding it inwardly. During inward sliding, the sloped surface urges the aperture 34 and the card 12 away from the detent 29. When fully inserted, aperture 34 engage the detent.

In alternative embodiments, not shown, a T-shaped release bar 20 is molded inward, and is pressed outward by a card. Means for engaging, such as ribs or springs 48, are molded inward with the top 18, as are guiding ribs positioned between or to the side of the blisters. Thus, the means for engaging support the card in holding the T-bar outward. The sloping back surfaces of the detents and the inward surfaces of ribs are radiused along with other card surfaces to facilitate sliding of the card or moving of the surfaces. The outer surface of the push bar has frictional grooves to aid in pushing the bar inward. A plurality of parallel holes 34 on the card engage parallel detents formed within the case. Pressing inward on the T-shaped release 20 warps a part of the card 12 away from the detents in opposition to the force provided by the means for engaging. The warping of the card moves the holes 34 away from the detents 29 so that the tray 12 may be slid through the open end 40 of the sleeve 14. Withdrawing pressure from the bar 20, that is releasing the bar, stops the tray in the next outward position.

The blister card may be a conventional blister package with a strategically placed hole or holes 34 added to perform the function of a detent receiver and/or a retainer receiver. As will be understood by one skilled in the art, detent and retainer receivers may be created by forming such while forming the blisters. The whole laminated cross-section of the plastic blister layer and the paper base provides strength. A constant containment element surrounds the blister card and forms the new locking case, container, or package. Detents in one hole or holes in parallel series of holes prevent unwanted outward movement of the tray. A push, pull and release sequence limits the exposure of blisters. Reverse pressure easily slides the blister tray back into the containment elements without manipulation of parts.

While the invention has been described with reference to specific embodiments, modifications and variations of the invention may be constructed without departing from the scope of the invention.

We claim:

1. A storing and dispensing system, comprising:

a case; and a slideable card holding items to be dispensed, said card comprising at least one receiver;

said case comprising:

a first side matingly connected to a second side to form a void for receiving said card;

opposing closed edges and a closed end formed by said mated connection and further defining said void;

an open end opposite said closed end configured to permit said card to translate between a first position and a second position;

at least one detent extending from one of said sides toward said void for engaging a respective given receiver;

at least one inwardly-extending appurtenant disposed adjacent to one said detent so as to exert a compressive force to urge its respective receiver to engage said one detent; and a release proximate to said one detent configured to disengage said respective given receiver and said one detent;

whereby engaging said one detent and said respective given receiver locks said card within said case, and manipulating said release to disengage said one detent and said respective given receiver unlocks said card.

2. The system of claim 1, wherein said first position comprises said one detent engaged with said respective given receiver, and said card is substantially enclosed within said case.

3. The system of claim 1, wherein said second position comprises a retainer engaged with a respective given receiver, and said card is substantially extended beyond said case.

4. The system of claim 1, wherein said card comprises a unit dose blister card holding consumable medicaments.

5. A storing and dispensing system, comprising:

a case and a slideable card holding items to be dispensed;

said card comprising at least one first receiver aperture;

said case comprising:

a first side matingly connected to a second side to form a void for receiving said card;

opposing closed edges and a closed end formed by said mated connection and further defining said void;

an open end opposite said closed end configured to permit said card to translate between a first position and a second position;

at least one detent extending from one of said sides toward said void for engaging a respective said at least one first receiver aperture;

a release proximate to said at least one detent configured to disengage said respective said at least one first receiver aperture and said at least one detent; and a retainer located within said void having a fixed end and a distal free end, said free end configured to engage said respective said at least one first receiver aperture and interrupt the separation of said card from said case;

whereby engaging said at least one detent and said respective said at least one first receiver aperture locks said card within said case, and manipulating said release to disengage said at least one detent and said respective said at least one first receiver aperture unlocks said card.

6. The system of claim 5, wherein said card comprises a unit dose blister card holding consumable medicaments.

7. A storing and dispensing system, comprising:

a blister card holding items to be dispensed, said card comprising at least one receiving aperture;

a case defining a void therein;

at least one detent extending from the case toward said void, said at least one detent being configured for engaging a respective said at least one receiving aperture; and a retainer located within said void having a fixed end and a distal free end, said free end configured to interlock with said at least one receiving aperture and interrupt the separation of said card from the case, wherein said retainer is configured to permit said free end to be disengaged from said at least one receiving aperture by a replacement card.

8. The system of claim 7, wherein said card holds consumable medicaments.

9. The system of claim 7, further comprising a release proximate to said at least one detent configured to disengage said respective said at least one receiving aperture and said at least one detent.

10. The system of claim 7, wherein the engagement of the at least one detent with said respective said at least one receiving aperture locks said card in an inserted position within the case.

* * * * *